US005765705A

United States Patent [19]

Deubel

[11] Patent Number: 5,765,705

[45] Date of Patent: Jun. 16, 1998

[54] CHILD RESISTANT CLOSURE

[75] Inventor: Donald P. Deubel, Bel Air, Md.

[73] Assignee: Poly-Seal Corporation, Baltimore, Md.

[21] Appl. No.: 689,087

[22] Filed: Jul. 30, 1996

[51] Int. Cl.[6] ..... B65D 55/02

[52] U.S. Cl. ..... 215/216; 215/237

[58] Field of Search ..... 215/206, 209, 215/216, 224, 225, 237

[56] References Cited

U.S. PATENT DOCUMENTS

| | | | |
|---|---|---|---|
| Re. 29,793 | 10/1978 | Pehr . | |
| 3,850,326 | 11/1974 | Ryles . | |
| 4,022,352 | 5/1977 | Pehr . | |
| 4,042,105 | 8/1977 | Taylor . | |
| 4,244,495 | 1/1981 | Lorscheid et al. . | |
| 4,444,326 | 4/1984 | Musel . | |
| 4,629,081 | 12/1986 | McLaren . | |
| 4,718,567 | 1/1988 | La Vange . | |
| 4,759,455 | 7/1988 | Wilson . | |
| 4,782,964 | 11/1988 | Poore et al. . | |
| 4,807,768 | 2/1989 | Gach | 215/216 |
| 4,821,898 | 4/1989 | Smalley . | |
| 4,838,441 | 6/1989 | Chernack . | |
| 4,892,208 | 1/1990 | Sledge . | |
| 5,033,634 | 7/1991 | Batchelor et al. | 220/281 |
| 5,092,493 | 3/1992 | Pehr . | |
| 5,137,260 | 8/1992 | Pehr . | |
| 5,180,072 | 1/1993 | Oehlert | 215/209 |
| 5,207,657 | 5/1993 | Gibilisco . | |

*Primary Examiner*—Stephen Cronin
*Attorney, Agent, or Firm*—Dickstein Shapiro Morin & Oshinsky LLP

[57] ABSTRACT

A child resistant closure including a container and a cap. The container includes a body portion defining a chamber, and a hollow neck extending from the body portion. The cap is formed to fit around the neck and includes a base portion and a lid portion connected to the base portion with a hinge. At least one first engagement portion extends from a lever portion attached to the base portion, and is positioned to engage at least one second engagement portion that is integrally formed in the lid portion. The engagement portions are located off set from a location diametrically opposite the hinge. The closure is in a locked position when the first engagement portion engages the second engagement portion. The closure is moved to an unlocked position when the lever portion is pushed inwardly to disengage the first engagement portion from the second engagement portion.

15 Claims, 4 Drawing Sheets

CHILD RESISTANT CLOSURE

BACKGROUND

The present invention relates to closures for bottles, and more specifically, to child resistant safety closures.

Safety closures that prevent children from opening containers are useful for medicine bottles, cleaning supplies containers, or bottles containing other dangerous substances. To be effective, safety closures must be too difficult for children to operate yet easy for adults to manipulate. In addition, safety cap designs must recognize the limitations of the manufacturing process and therefore, the designs should be simple and have few parts in order to be manufactured and assembled easily and economically.

Many safety closure have two caps, one of which fits over the other. The outer cap must be pushed down firmly in order to engage and turn the inner cap. Another type of closure requires the user to line up a section of the cap with a section of the container and then push the cap upwardly to pop it off. A third type of closure requires the user to push inwardly a portion of the cap or container that is located opposite a hinge and then lift the cap and rotate it about the hinge.

One of the problems with the closures in the prior art is accidental opening of closures by children who inadvertently disengage the safety mechanism. For example, closures whose safety features are located near the opening tab are particularly susceptible to inadvertent opening. When attempting to open any closure, children handle the area near the opening tab, which is often located diametrically opposite the closure's hinge, because it is natural to open closures by gripping a tab. Closures use tabs, in fact, in order to facilitate their opening. It is not surprising, therefore, that a child intending to handle a tab would inadvertently disengage a safety mechanism located proximate the tab.

A second problem with the child safety closures of the prior art is high manufacture costs which are incurred because the designs are too complicated and use too much material. Moreover, assembly of many closures is cumbersome because of the complexity of the designs and the number of parts. For example, closures that interact with features on the container require proper alignment before assembly. This alignment step adds to the complexity and cost of assembly.

Another problem with child resistant safety closures involves the amount of force required to disengage the safety mechanism. For example, having to deform the container or cap to disengage the safety mechanism requires the adult to apply a significant force to either the container or the cap, which is difficult for the elderly, the infirm, and arthritis sufferers. A similar use of force is needed for those safety caps which require the operator to push downward on the cap and turn to open the container.

Therefore, there is a need in the art for a child resistant safety closure whose method of disengaging the safety mechanism is not obvious to the child and does not require a lot of force, that avoids incidences of inadvertent and accidental opening, and that can be manufactured and assembled both economically and easily.

SUMMARY

The present invention alleviates to a great extent the disadvantages of the prior art by providing a child resistant safety closure including a container in which flanges extend from the outside surface and encircle the neck. A cap fits around the neck and has both a base portion and a lid portion connected to the base portion by a hinge. Both the base portion and the lid portion include flanges positioned to engage the container's flanges. A portion of lid portion engages a portion of the base portion in order to lock the closures. These engagement portions are located off set from the hinge.

It is an objective of the present invention to provide a child resistant safety closure that may be opened easily by an adult once he is given proper instruction.

It is another objective of this invention to provide a child resistant closure that is difficult for children to open because the disengagement of the safety mechanism is not obvious to the child.

It is an additional objective of the present invention to provide a child resistant closure which reduces the probability of inadvertent or accidental opening by a child.

It is yet an additional objective of the present invention to provide a child resistant closure that is easy to close It is another objective of the present invention to provide a child resistant closure that does not require the user to provide substantially more force to open than a non-child proof closure requires.

It is a further objective of the present invention to provide a child resistant safety closure that is simpler to manufacture and assemble than those in the prior art.

These and other objects, features and advantages of the present invention will become apparent from the following detailed description, drawings, abstract and claims of preferred embodiments of the present invention.

DETAILED DESCRIPTION OF A PREFERRED EMBODIMENT

Figure 1:
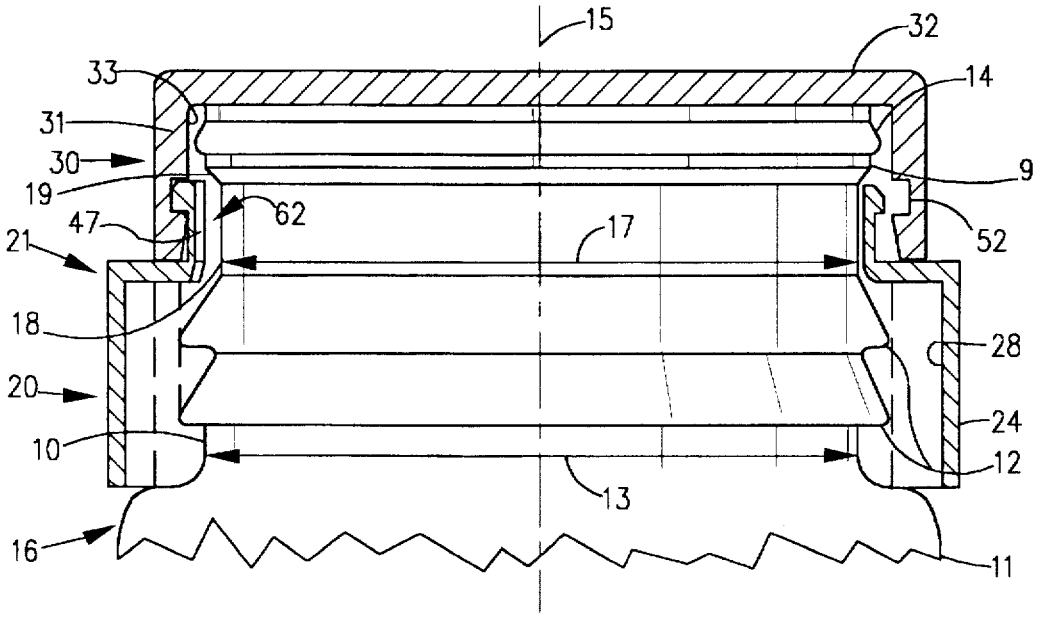
FIG. 1 is a cross-sectional elevation view of a child resistant closure according to a preferred embodiment of the present invention, showing the cap and container assembled.
Figure 2:
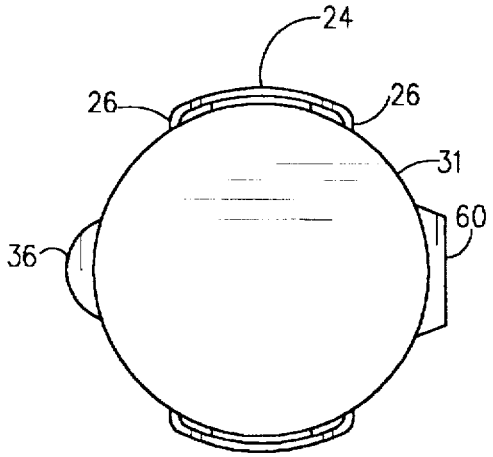
FIG. 2 is a top view of the container of FIG. 1 in a closed and locked position.
Figure 3:
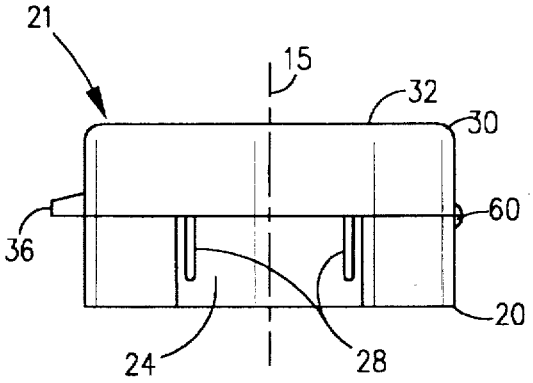
FIG. 3 is a side view taken of the cap of FIG. 2.

Refer now to FIGS. 1–3 showing a child resistant closure in the closed position according to a preferred embodiment of the present invention. The closure includes two pieces: a container 16 and a cap 21. The container 16 has a hollow container neck 10 which extends from the container body 11 and an outside diameter 13. When the closure is assembled, the cap 21 fits around the container neck 10 and is concentric with the container's axis 15.

A number of flanges 12, 14, 22, 34 protrude outwardly from the periphery of the container 16 and inwardly from the cap 21. These flanges are referred to as "beads." The beads 12, 14 on the container 16 engage the beads 22, 34 on the cap 21 in order to secure the cap 21 to the container 16 when the closure is assembled and closed. The pair of first container beads 12 encircles the container neck 10 at axial locations proximate the container body 11. The second container bead 14 also encircles the container neck 10 but is located axially proximate the top of the container 16.

Figure 5:
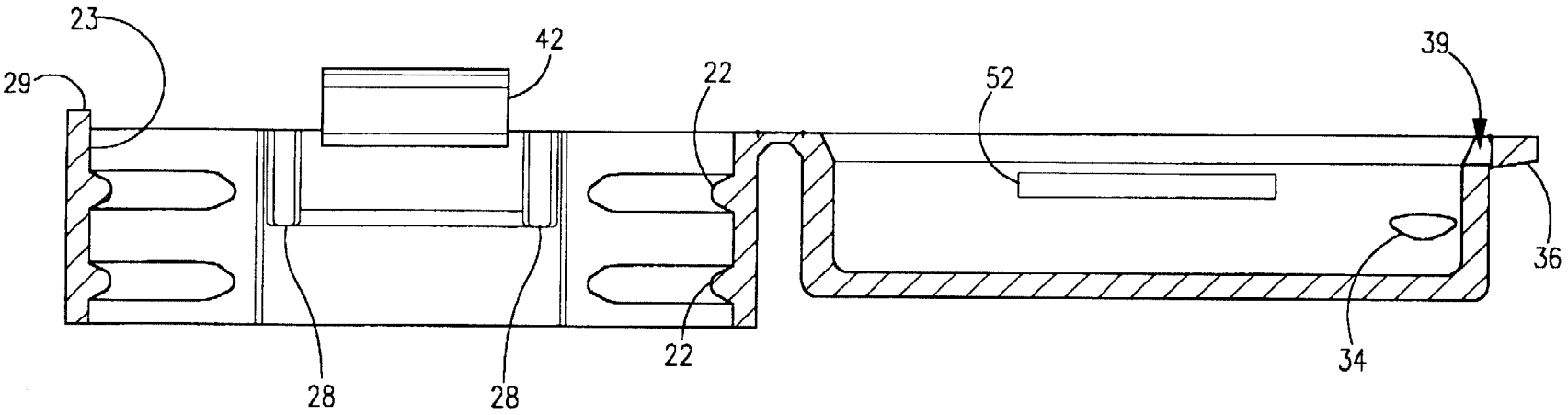
FIG. 5 is a view taken along section line V—V of FIG. 4.

The cap 21 is a single integrally molded piece and includes a cap base portion 20 connected to a cap lid portion 30 by a hinge 60. The cap base portion 20 includes a pair of first cap beads 22 extending inwardly from the inside surface 23 of the cap 21. (See FIG. 5) The pair of first cap beads 22 is positioned and sized to engage the pair of first container beads 12 when the closure is assembled. The pair of first cap beads 22 and the pair of first container beads 12 make up the first bead set 12, 22. The engagement of the first bead set 12, 22 secures the base portion 20 to the container neck 10. Although FIGS. 1 and 5 shows pairs of first container beads 12 and first cap beads 22, a single container bead 12 engaging a single cap bead 22 could be used to secure the cap 21 to the container 16.

The cap lid portion 30 includes a cap lid wall 31 which extends from the perimeter of a flat cap top 32 to form a cylinder. A second cap bead 34 is discontinuous and extends inwardly from the periphery of the inside surface 33 of the cap lid wall 31 proximate the lifting tab 36 (see FIG. 4). This second cap bead 34 is positioned and sized to engage the second container bead 14. The discontinuity of the second bead 34 is located opposite the hinge 60, and makes the cap 21 easier to open when the safety mechanism is disengaged. In addition, because the second cap bead 34 is discontinuous, the cap 21 is easier to manufacture.

The second cap bead 34 and the second container bead 14 make up the second bead set 14, 34. The engagement of the second bead set 14, 34 secures the lid portion 30 to the container neck 10 when the closure is closed. When the second cap bead 34 engages the second container bead 14, it lies proximate an intermediate portion 9 of the container neck 10 that is located below the second container bead 14.

In the embodiment shown in FIG. 1, the second container bead set 14, 34 is smaller than the first container bead set 12, 22. The smaller size of the second container bead set 14, 34 facilitates the assembly of the closure. During assembly, the pair of first cap beads 22 easily slides over the second container bead 14 because the second container bead 14 is smaller. Nevertheless, the relative sizes of all the beads 12, 14, 22, 34 may vary.

Returning now to the container 16, an recessed portion 18 of the container neck 10 is located between the beads 12, 14. The outer diameter 17 of the recessed portion 18 is slightly less than the outer diameter 13 of the container neck 10 such that the recessed portion 18 and the cap 21 create a clearance area 62 all the way around the neck when the closure is assembled. An angled portion 19 of the container neck 10 extends between the recessed portion 18 and the intermediate portion 9 of the container neck 10.

Referring now to the cap 21, the cap base portion 20 includes a pair of lever tabs 24, each attached to the cap lid wall 31 at two connecting ends 26. (See FIG. 2) The lever tabs 24 may also be attached to the cap 21 in other ways, such as with a single or multiple tethers attached at the bottoms of the lever tabs 24. The lever tabs 24 each encircle the cap 21 for approximately 45 degrees and contain a pair of slots 28 (see FIG. 3) which allows them 24 to deflect more easily during disengagement of the safety mechanism. In the embodiment shown in FIGS. 1–7, each lever tab 24 is located about one hundred and eighty degrees from the other one and about ninety degrees from the hinge 60. Other locations and sizes are nevertheless possible. The lever tab 24 should not be at the location of the lifting tab 36, however, in order to decrease the likelihood of accidental opening and increase the child resistant properties. The lever tabs 24 and the engaging portions of the cap lid wall 31 form the closure's safety mechanism. The lever tab 24 on the left side of FIG. 1 is in the locked position in which it engages a portion of the cap lid wall 31. The lever tabs 24 may be moved towards the axis 15 to an unlocked position, as shown by the position of the lever tab 24 on the right side of FIG. 1.

Figure 4:
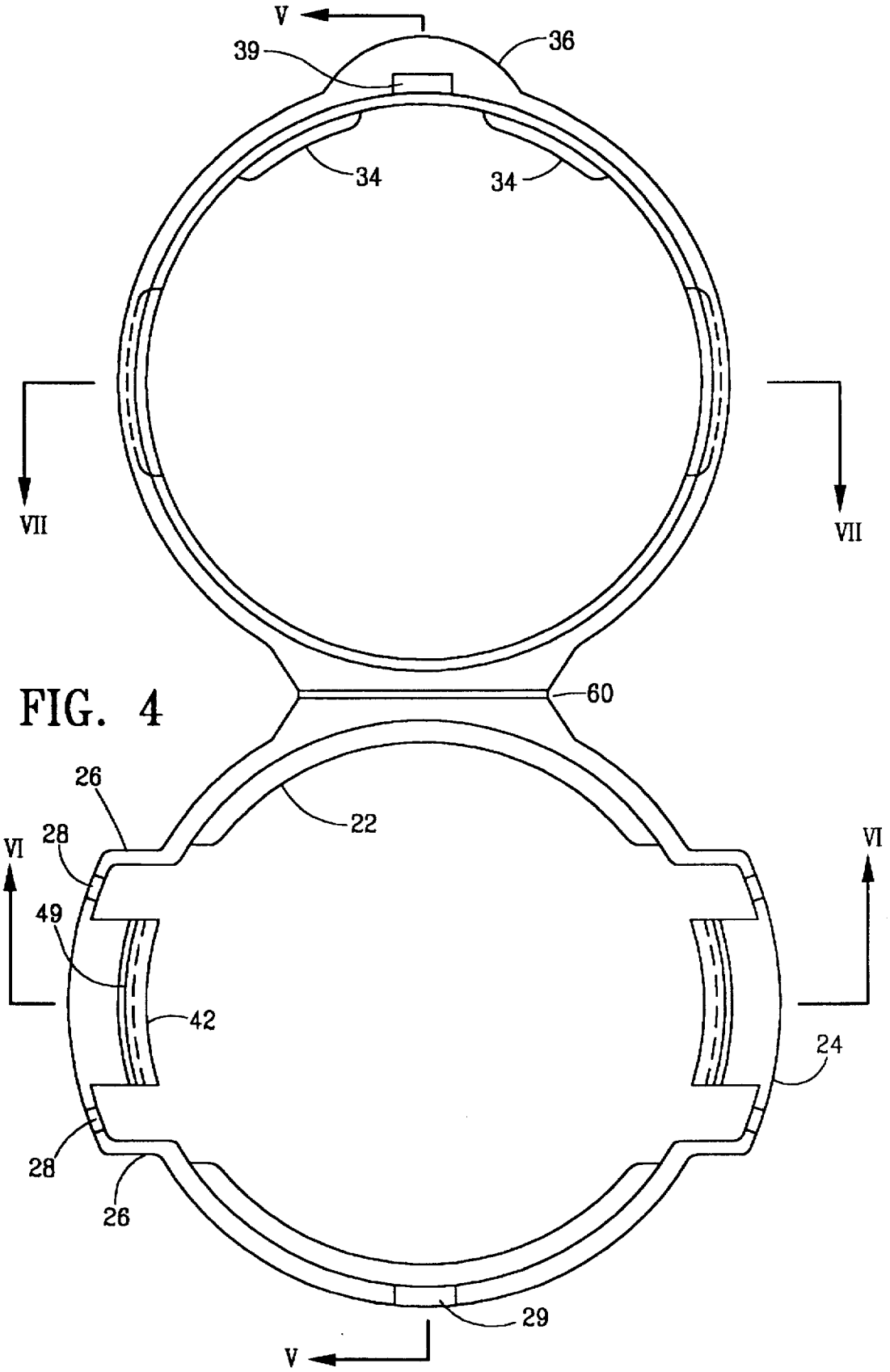
FIG. 4 is a top view of the cap of FIG. 1 in an open position.

As seen in FIGS. 4 and 5, the cap base portion 20 includes a protrusion 29 that extends from the cap base portion 20 at a location opposite the hinge 60. This protrusion 29 mates with a lifting tab recess 39 formed in the cap lid portion 30. In the embodiment shown in FIGS. 4 and 5, the protrusion 29 extends upwards from the cap base portion 20 and the lifting tab recess 39 is formed within the cap lid wall 31 and the lifting tab 36, but other locations and orientations are contemplated. For example, the protrusion 29 could extend radially from the cap base portion 20 and the lifting tab recess 39 could be formed in an extension of the cap lid wall 31 or the lifting tab 36. The protrusion 29 and the lifting tab recess 39 help align the cap base portion 20 with the cap lid portion 30. In addition, the mating of protrusion 29 with the lifting tab recess 39 reduces the cap's 21 tendency to bulge outwardly 90 degrees from the lever tabs 24 when the lever tabs 24 are pressed inwardly. The hinge 60 also reduces this tendency.

Figure 6:
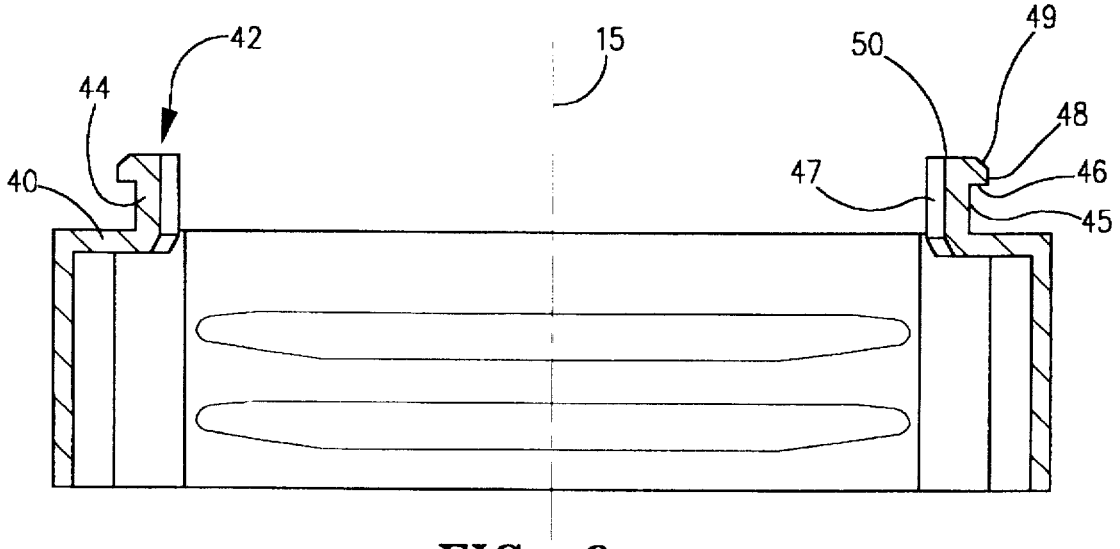
FIG. 6 is a view taken along section line VI—VI of FIG. 4.

Refer now to FIG. 6 showing the cap base portion 20. Connecting bars 40 extend from the lever tabs 24 inwardly towards the axis 15. These connecting bars 40 are flat and lie in a plane perpendicular to the axis 15 of the container 16. Hook members 42 are attached to the connecting bars 40. The hook members 42 each include a stem 44 having a stem front surface 45 and a stem back surface 47. A lower angled surface 43 extends between the stem back surface 47 and the connecting bar 40. Each hook members 42 also includes a substantially flat bottom surface 46 located adjacent and perpendicular to the stem front surface 45, and a substantially flat top surface 50 located adjacent and perpendicular to the stem back surface 47. The top 50 and bottom surfaces 46 are parallel to each other. A curved side surface 48 extends from the stem bottom surface 46 and an angled intermediate surface 49 extends from the side surface 48 to the top surface 50. The stem front 45 and back surfaces 47 are parallel to each other. Although the hook members 42 are shown with this particular geometry, they may have other shapes.

The hook members 42 are oriented such that the stem back surfaces 47 face the container 16 and the stem front surfaces 45 and the side surfaces 48 face the cap lid wall 31. (See FIG. 1) Pushing on the lever tabs 24 moves the hook members 42 towards the axis 15 and into the clearance area 62. The recessed portion 18 defines the outer limit of the hook members' 42 range of motion when a user presses the lever tabs 24 inwardly. If a user pushes the lever tabs 24 with sufficient force, the stem back surface 47 will come into contact with the recessed portion 18, as shown by the lever tab 24 on the right side of FIG. 1. Restricting the lever tabs' 24 motion in this manner prevents the lever tabs 24 from breaking during use.

Figure 7:
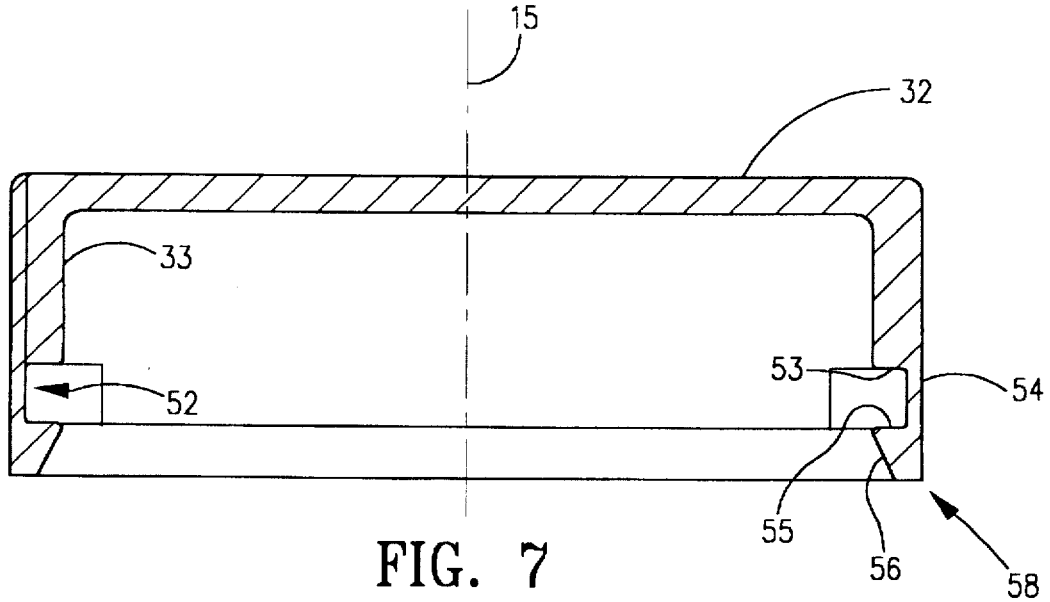
FIG. 7 is a view taken along section line VII—VII of FIG. 4.

Refer now to FIG. 7 showing the cap lid portion 30. Below the axial location of the second cap bead 34, a pair of recesses 52 are formed in the cap lid inside surface 33. Each recess 52 includes substantially flat top 53 and bottom lateral sides 55 which are parallel to each other. A longitudinal side 54 extends between the lateral sides 53, 55. The longitudinal side 54 is perpendicular to the lateral sides 53, 55 and has the same curvature as the cap lid wall 31. However, the longitudinal side 54 may also be substantially flat. Located slightly below the bottom lateral side 55, a slanted face 56 is formed in the cap lid wall 31. The recess 52 and the slanted face 56 define a receiving hook member 58, which is the engaging portion of the cap lid wall 31.

In the closed position, FIGS. 1–3, the hook members 42 engage the receiving hook members 58 in order to lock the closure. In this locked position, the bottom surfaces 46, the side surfaces 48, and the angled intermediate surfaces 49 fit within the recesses 52. The lever tab 24 in the left side of FIG. 1 shows the locked position.

In order to open the closure, a user pushes the lever tabs 24 inwardly, which deforms the base portion 20 and moves the hook members 42 into the clearance area 62. This motion disengages the hook members 42 from the receiving hook members 58. The lever tab 24 in the right side of FIG. 1 shows the unlocked position. Thus, to open, both lever tabs 24 are depressed to their respective unlocked positions and the user then lifts up on the lifting tab 36 and pivots the cap lid portion 30 about the hinge 60.

In the embodiment shown in FIGS. 2–4, the lifting tab 36 extends from the cap lid portion 30 at a location diametrically opposite the hinge 60 to facilitate moving the cap lid portion 30. The user grips the lifting tab 36 in order to lift the cap lid portion 30 and move the closure to the open position. (See FIGS. 4 and 5) In a preferred embodiment, the lifting tab 36 is arcuately shaped, but it may have other forms. One could lift the cap lid portion 30 into the open position without the use of a lifting tab 36, however, by using a fingernail or pulling on the cap lid portion 30 directly. Moreover, the hinge 60 could be designed to lift the cap lid portion 30 open automatically once the lever tabs 24 are moved to the unlocked position.

In order to close the closure, one simply rotates the cap lid portion about the hinge 60 in the opposite direction as when opening. The slanted faces 56 slide over the angled intermediate surfaces 49 and the hook members 42 and the receiving hook members 58 deflect away from each other to allow the cap lid portion 30 to move into the closed position. The resilient force of the hook members 42 and the receiving hook members 58 causes these members 42, 58 to spring into engagement with each other. The closure thus locks.

In the alternative, a user may depress the lever tabs 24 inwardly while rotating the cap lid portion 30 closed in order to prevent the hook members 42 from coming into contact with the receiving hook members 58. Once the user releases the lever tabs 24, the resilient force causes the closure to lock as described above.

The safety mechanism, therefore, includes the hook members 42 and the receiving hook members 58. The location of the lever tabs 24 and the safety mechanism is an advantage of the present invention for several reasons. First, the easiest way to open a hinged closure involves gripping the area diametrically opposite the hinge because gripping this area allows the user to use leverage to open the closure. A child naturally handles this area when confronted with a hinged closure. Therefore, safety mechanisms located one hundred and eighty degrees from the hinge 60 are more likely to be opened inadvertently by children handling the closure. Locating the lever tabs 24, the hook members 42, and the receiving hook members 58 ninety degrees, or otherwise off set, from the area opposite the hinge 60 reduces the chance that a child will inadvertently disengage the safety mechanism by handling the closure in an ordinary way.

Similarly, locating the safety mechanism away from the lifting tab 36 reduces the potential for inadvertent opening since children naturally grip lifting tabs to open closures. If, for example, a single lever tab 24 were located proximate the lifting tab 36, a child could inadvertently push the lever tab 24 inwardly while attempting to pull up on the lifting tab 36.

Furthermore, using a pair of lever tabs 24 improves the closure's resistance to inadvertent opening since a child would have to manipulate both lever tabs 24 unintentionally. Using two diametrically opposed safety mechanisms that are located ninety degrees from the lifting tab 36 ensures that the closure must be opened with two hands. It is improbable that a child would inadvertently depress both lever tabs 24 with one hand while pulling upwardly on the lifting tab 36 with the other.

The single piece cap 1 and the two sets of beads 12, 14, 22, 34 also offer advantages over the prior art. The single cap 1 may be pushed onto the container 16 without having to align the cap 1 with any feature on the container 16 because the safety mechanism does not employ any feature of the cap 1. Accordingly, using a base portion 20 and cap lid portion 30 facilitates the closure's assembly and therefore, its manufacturing. Moreover, the beads 12, 14, 22, 34 secure the cap 1 to the container without having to mate with any feature on the container 16, such as a screw thread. Thus, the beads 12, 14, 22, 34 add to the assembling ease of the present invention.

The above description and drawings are only illustrative of preferred embodiments of the present invention, and are not intended to limit the present invention thereto. Any modification of the present invention which comes within the spirit and scope of the following claims is to be considered part of the present invention. The above description discloses specific shapes, configurations and locations for the hook members 42, the recesses 52, the receiving hook members 58, the first and second cap and container beads 12, 14, 22, 34 and other elements. Nevertheless, other shapes, configurations, and locations are possible.

Furthermore, the safety mechanism of the present invention would be effective in the absence of a hinge 60. Without a hinge 60, a user would open the closure by pressing the lever tabs 24 inwardly and pulling the cap lid portion 30 off completely.

What is claimed as new and desired to be protected by Letters Patent of the United States is:

1. A child resistant closure comprising:

a container including a body portion defining a chamber, and a hollow neck extending from said body portion;

a cap formed to fit around said neck and having a base portion and a lid portion connected to said base portion with a hinge;

said base portion including at least one first engagement portion extending from said base portion;

said lid portion including at least one second engagement portion formed in said lid portion, and positioned to engage said first engagement portion;

wherein said first and second engagement portions are located off set from a location diametrically opposite said hinge;

wherein the closure is in a locked position when said first engagement portion engages said second engagement portion; and wherein said first engagement portion is arranged to disengage from said second engagement portion upon the inward movement of said base portion proximate the first engagement portion.

2. The closure of claim 1 further comprising:

a pair of first engagement portions each one of which is located diametrically opposite said other one; and a pair of second engagement portions each one of which is located diametrically opposite said other one.

3. The closure of claim 1 wherein said second engagement portion is integrally formed in a cylindrical wall extending from a perimeter of a top portion of said lid portion.

4. The closure of claim 1 further comprising a tab protruding from said top located diametrically opposite said hinge.

5. A child resistant closure comprising:

a container including a body portion defining a chamber, and a hollow neck extending from said body portion;

a cap formed to fit around said neck and having a base portion and a lid portion connected to said base portion with a hinge;

said base portion including at least one first engagement portion extending from said base portion;

said lid portion including at least one second engagement portion formed in said lid portion, and positioned to engage said first engagement portion;

wherein said first and second engagement portions are located off set from a location diametrically opposite said hinge;

wherein the closure is in a locked position when said first engagement portion engages said second engagement portion;

wherein the closure is moved to an unlocked position when said base portion is pushed inwardly to disengage said first engagement portion from said second engagement portion; and wherein said first engagement portion extends from a lever portion extending from said base portion.

6. A child resistant closure comprising:

a container including a body portion defining a chamber, a hollow neck extending from said body portion and having an outside surface, at least one first container bead extending from said outside surface and encircling said neck, and a second container bead extending from said outside surface and encircling said neck;

a cap formed to fit around said neck and having a base portion and a lid portion connected to said base portion with a hinge;

said base portion including at least one lever portion attached to said base portion, and at least one first cap bead extending from said base portion and positioned to engage said first container bead;

said lid portion including a substantially planar top member, a cylindrical wall extending from a perimeter of said top member, a second cap bead extending from an inner surface of said cylindrical wall and positioned to engage said second container bead;

at least one first engagement portion extending from said lever portion;

at least one second engagement portion integrally formed in said lid portion, and positioned to engage said first engagement portion;

wherein said first and second engagement portions are located off set from a location diametrically opposite said hinge;

wherein the closure is in a locked position when said first engagement portion engages said second engagement portion; and wherein the closure is moved to an unlocked position when said lever portion is pushed inwardly to disengage said first engagement portion from said second engagement portion.

7. The closure of claim 6 wherein said second engagement portion is integrally formed in said cylindrical wall.

8. The closure of claim 6 further comprising:

a pair of first engagement portions each one of which is located diametrically opposite said other one; and a pair of second engagement portions each one of which is located diametrically opposite said other one.

9. The closure of claim 6 further comprising:

a tab protruding from said top member.

10. The closure of claim 6 wherein said first engagement portion further comprises a hook member having a curved portion which faces said cap lid wall.

11. The closure of claim 10 wherein said second engagement portion further comprises a recess formed in said inner surface of said cylindrical wall and is shaped to receive said curved portion when said first and second engagement portions engage each other.

12. The closure of claim 6 wherein container neck includes at least one backstop surface positioned proximate said lever portion which restricts the inward motion of said lever portion.

13. The closure of claim 6 wherein said base portion and said lid portion are integrally formed in a single piece.

14. The closure of claim 6 wherein said second cap bead is discontinuous.

15. A child resistant closure comprising:

a container including a body portion defining a chamber, a hollow neck extending from said body portion and having an outside surface, a pair of first container beads extending from said outside surface and encircling said neck, and a second container bead extending from said outside surface and encircling said neck;

a cap formed to fit around said neck and having a base portion and a lid portion connected to said base portion with a hinge;

wherein said base portion and said lid portion are integrally formed in a single piece;

said base portion including a pair of lever portions attached to said base portion by a pair of connecting ends, and a pair of first cap beads extending from an inner surface of said base portion towards said container and positioned to engage said first container beads;

said lid portion including a substantially planar top member, a cylindrical wall extending from a perimeter of said top member, a tab protruding from said top member, and a second discontinuous cap bead extending from an inner surface of said cylindrical wall towards said container and positioned proximate said tab to engage said second container bead;

a first pair of engagement portions extending from said lever portions and located approximately one hundred and eighty degrees from each other and approximately ninety degrees from said hinge;

a second pair of engagement portion integrally formed in said cylindrical wall, located one hundred and eighty degrees from each other and ninety degrees from said hinge, and positioned to engage said first pair of engagement portions;

a pair of backstop surfaces located on an outer surface of said cap and positioned proximate said lever portions;

wherein said first pair of engagement portions includes a connecting member and a hook member extending from said connecting member which includes a stem having a stem front surface and a stem back surface opposite said front surface, a substantially flat bottom surface adjacent and perpendicular to said front surface, a curved side surface extending from said bottom surface parallel with said stem, an angled intermediate surface extending from said side surface, a substantially flat top surface extending from said intermediate surface parallel to said bottom surface and perpendicular to said stem back surface;

wherein said hook member is oriented such that said stem back surface faces said container and said side surface faces said cap lid wall;

wherein said second pair of engagement portions includes a recess formed in said inner surface of said cylindrical wall and having a top and a bottom substantially flat lateral sides parallel to each other and a longitudinal side located between and perpendicular to said lateral sides and having the same curvature as said cylindrical wall, and a slanted face formed in said cylindrical wall and located below said bottom lateral side and angling away from said container;

wherein said tab is arcuate and located ninety degrees from each of said lever portions and one hundred and eighty degrees from said hinge;

wherein the closure is in a locked position when said bottom surface, said intermediate surface, and said side surface of said hook member fit within said recess;

wherein the closure is moved to an unlocked position when said lever portions are pushed inwardly in order to disengage said hook member from said recess; and wherein said backstop surfaces restrict the inward motion of said lever.

* * * * *